US009157612B2

(12) United States Patent
Alfier et al.

(10) Patent No.: US 9,157,612 B2
(45) Date of Patent: Oct. 13, 2015

(54) LIGHTING ASSEMBLY

(75) Inventors: Alberto Alfier, Vedelago (IT); Matthias Fiegler, Deisenhofen (DE); Stefan Lorenz, Obertraubling (DE); Alessandro Scordino, Dolo (IT)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 13/880,643

(22) PCT Filed: Oct. 18, 2011

(86) PCT No.: PCT/EP2011/068178

§ 371 (c)(1), (2), (4) Date: Apr. 24, 2013

(87) PCT Pub. No.: WO2012/052430

PCT Pub. Date: Apr. 26, 2012

(65) Prior Publication Data

US 2013/0208484 A1 Aug. 15, 2013

(30) Foreign Application Priority Data

Oct. 19, 2010 (IT) ..... TO2010A0846

(51) Int. Cl.

| | |
|---|---|
| ***F21V 21/00*** | (2006.01) |
| ***F21V 23/06*** | (2006.01) |
| ***F21V 29/00*** | (2015.01) |
| ***F21V 19/00*** | (2006.01) |
| ***F21V 29/76*** | (2015.01) |
| *F21V 7/00* | (2006.01) |
| *F21V 7/09* | (2006.01) |

(Continued)

(52) U.S. Cl.

CPC ..... *F21V 21/00* (2013.01); *F21V 7/0025* (2013.01); *F21V 19/0035* (2013.01); *F21V 29/004* (2013.01); *F21V 29/763* (2015.01); *F21V 7/005* (2013.01); *F21V 7/09* (2013.01); *F21V 17/005* (2013.01); *F21V 17/12* (2013.01); *F21V 19/0055* (2013.01); *F21V 23/06* (2013.01); *F21W 2131/103* (2013.01); *F21Y 2101/02* (2013.01); *F21Y 2103/003* (2013.01)

(58) Field of Classification Search

CPC ..... F21V 21/00; F21V 23/06

USPC ..... 362/296.01, 297

See application file for complete search history.

(56) References Cited

U.S. PATENT DOCUMENTS

| | | | | |
|---|---|---|---|---|
| 7,281,818 | B2 * | 10/2007 | You et al. | 362/241 |
| 2006/0061997 | A1 * | 3/2006 | Lin | 362/294 |

(Continued)

FOREIGN PATENT DOCUMENTS

| | | |
|---|---|---|
| CN | 101297153 | 10/2008 |
| CN | 101725853 | 6/2010 |

(Continued)

*Primary Examiner* — Haissa Philogene
*Assistant Examiner* — Pedro C Fernandez
(74) *Attorney, Agent, or Firm* — Cozen O'Connor

(57) ABSTRACT

A lighting assembly having a base body configured as a heat sink (18) having a front surface (18*a*), a board (14) carrying a light radiation source (12) applied on the front surface of the heat sink, and a fixing element (20) mounted on the front surface of the heat sink with the board arranged therebetween. The fixing element includes a window (22) which leaves at least partly uncovered the light radiation source, such window having side walls (220) which surround the light radiation source and spread outward to form a reflector for the light radiation.

11 Claims, 3 Drawing Sheets

(51) Int. Cl.

| | |
|---|---|
| *F21V 17/12* | (2006.01) |
| *F21W 131/103* | (2006.01) |
| *F21Y 101/02* | (2006.01) |
| *F21Y 103/00* | (2006.01) |
| *F21V 17/00* | (2006.01) |

(56) References Cited

U.S. PATENT DOCUMENTS

| | | | | |
|---|---|---|---|---|
| 2007/0097696 | A1* | 5/2007 | Eng et al. | 362/341 |
| 2007/0098334 | A1 | 5/2007 | Chen | |
| 2009/0001490 | A1* | 1/2009 | Bogner et al. | 257/432 |
| 2009/0310366 | A1 | 12/2009 | Huang et al. | |
| 2010/0103668 | A1 | 4/2010 | Lueken et al. | |

FOREIGN PATENT DOCUMENTS

| | | |
|---|---|---|
| DE | 10 2009 023 268 | 6/2010 |
| WO | WO 2007/049221 | 5/2007 |
| WO | WO 2010/004503 | 1/2010 |
| WO | WO 2012/007413 | 1/2012 |

* cited by examiner

FIG. 5
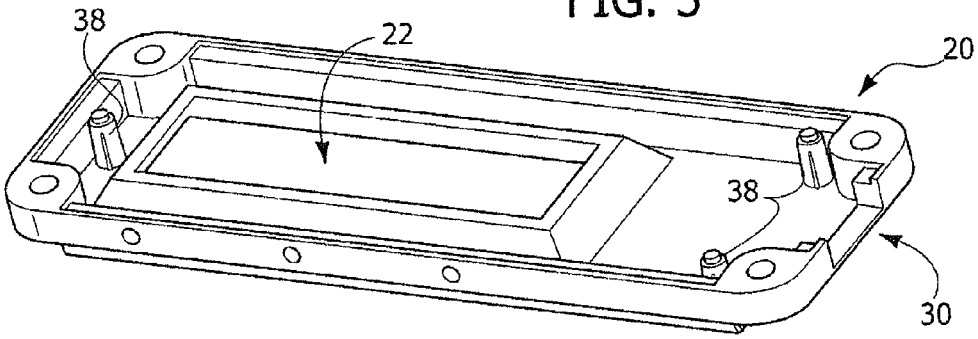
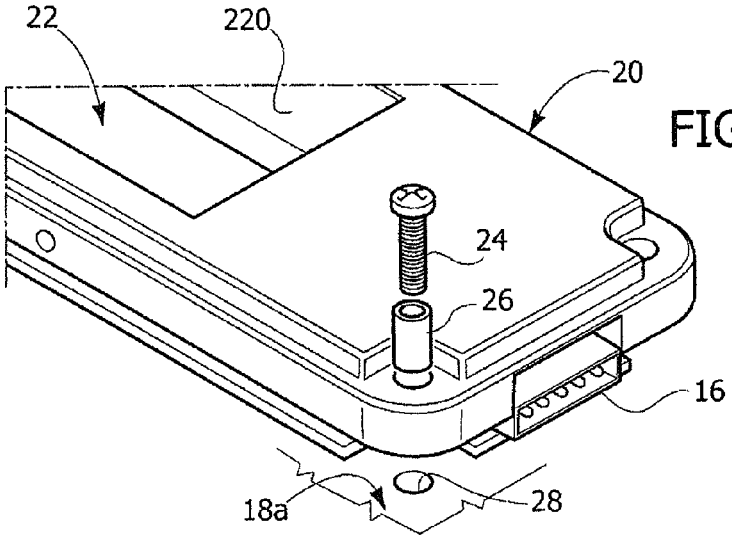
FIG. 6
FIG. 7
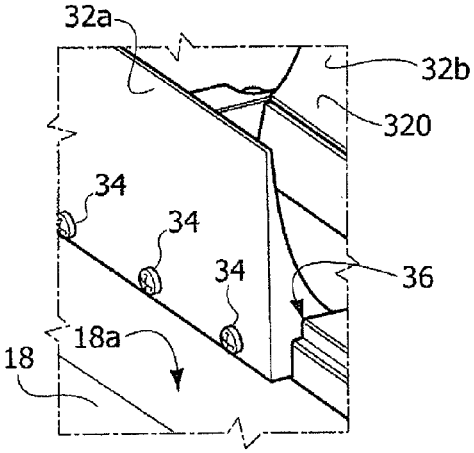
FIG. 8
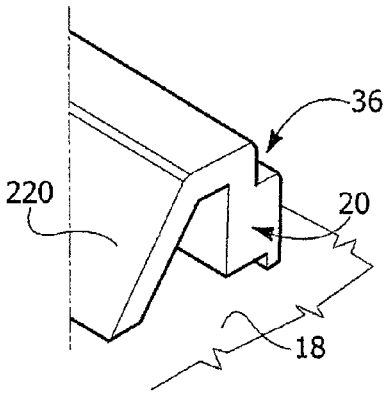

LIGHTING ASSEMBLY

RELATED APPLICATIONS

This is a U.S. national stage of International Application No. PCT/EP2011/068178 filed on Oct. 18, 2011.

This patent application claims the priority of Italian application no. TO2010A000846 filed Oct. 19, 2010, the disclosure content of which is hereby incorporated by reference.

FIELD OF THE INVENTION

The present invention relates to lighting assemblies.

In various embodiments, the invention relates to lighting assemblies usable, for example, for road lighting applications based on the utilization of LED light radiation sources. In various embodiments, the invention relates to power lighting applications, for example for road lighting.

BACKGROUND

In this technical field, various solutions for lighting assemblies are noted based on structures that may be defined as structures of the non-interactive type, such that they require rather complex electrical and/or mechanical connections and the utilization of additional components and processes (for example the provision of cables, bonding processes, etc.) such that they do not offer an effective level of flexibility in the installation/removal of the lighting assembly.

This tends to give rise to complex and bulky solutions that do not allow advantage to be taken, for example, of the advantageous compactness offered by the use of LED light radiation sources. This is the case, in particular, with regard to the possibility of reducing the complexity of the installation operations and of reducing the overall dimensions.

SUMMARY OF THE INVENTION

In various embodiments, the invention deals with the problem of overcoming the aforementioned drawbacks, for example in relation to the possible incorporation of what is referred to as an LED lighting "engine" in a road lighting system.

The purpose of this is accordingly to be able to offer, in various embodiments, at least one of the following advantages:

- compactness of the engine, for example in road lighting applications,
- simplification of the process of assembly between the mechanical and electrical components, for example mounting support and electronic board (Printed Circuit Board or PCB), in particular when LED sources are employed,
- standardized, stable and reliable mounting structure (also from the thermal standpoint),
- efficient adaptation and adjustment of the tolerances between the parts that are assembled, and
- integration between the mounting parts and the functional parts (for example, from the optical, mechanical, thermal and/or electrical/electronic standpoint).

In various embodiments, such a purpose is achieved thanks to a lighting assembly having the features claimed specifically in the claims that follow.

The claims form an integral part of the technical teaching presented here in relation to the invention.

In various embodiments, a standardized system is obtained that is able to use an envelope of simple shape (for example, square or rectangular) which can provide an attachment (for example, using screws) between the board (PCB) accommodating the electronics for the LED and a heat sink and/or a metal structure for fixing onto a post.

In various embodiments, the envelope is able to hold the board (PCB) onto the heat sink providing the thermal dissipation.

In various embodiments, the envelope can comprise a reflector referred to as "preliminary" reflector having the function of pre-mixing the light radiation from the LED sources, arranged, for example, in a Cluster' or, in other words, according to a solution of the type referred to as "Chip-on-Board".

In various embodiments, the structure of the envelope can also comprise mounting keys (pins and complementary holes), holes and/or profiled parts capable of providing a suitable mutual positioning with an external reflector and/or an optical structure whose function is to form the beam.

In various embodiments, the envelope can comprise holding structures that are facilitated by pin or by coupling or by snap fit so as to allow the electronic board carrying the LED or LEDs to be held, with the further possibility, where needed, of orienting the light source or sources and of holding said engine onto the heat sink.

In various embodiments, the fixing can be obtained, for example by means of screws, with the presence, where needed, of bushings, providing both the fixing and the optical coupling of the components.

In various embodiments, the invention is able to provide a structure exhibiting at least some of the following features:

- a solution for an integrated and compact envelope essentially corresponding to a kind of kit capable of allowing an electronic board (for example, using LEDs) to be assembled with the possibility of providing, with a completely reliable mounting, the fast mechanical, thermal, electrical and/or optical bonding of the components,
- alignment and fixing procedures whose utilization is both quick and precise,
- an automatic optical alignment and control of the lighting engine, and
- a reliable and standardized coupling system.

In various embodiments, the invention allows at least one of the following advantages to be offered:

- mechanical stability and good thermal management of the system,
- standardized assembly procedures (for example in the form of a kit that can be assembled for example using screws), with the possibility, where necessary, of replacing only the source or sources of the light radiation (for example, an LED array) for example for the purpose of improvement/updating of the latter,
- a high level of flexibility in positioning for assembly and removal, in particular with regard to the lighting engine, also later at the end of the useful life of the engine itself, and
- the possibility of ensuring the protection of the electronic circuits, for example associated with onboard detection systems situated on the board; this could for example be by means of a positioning that, to a certain extent, can be seen as distant with respect to the support dedicated to the thermal dissipation, which additionally allows the management with regard to electromagnetic interference (EMI) and the sensitivity of the detection system to be improved.

BRIEF DESCRIPTION OF THE FIGURES

The invention will now be described, by way of non-limiting example, with reference to the appended figures, in which:

FIGS. 3 to 5 illustrate some parts of one embodiment,
and
FIGS. 6 to 8 illustrate various details of embodiments.

DETAILED DESCRIPTION OF THE DRAWINGS

Figure 1:
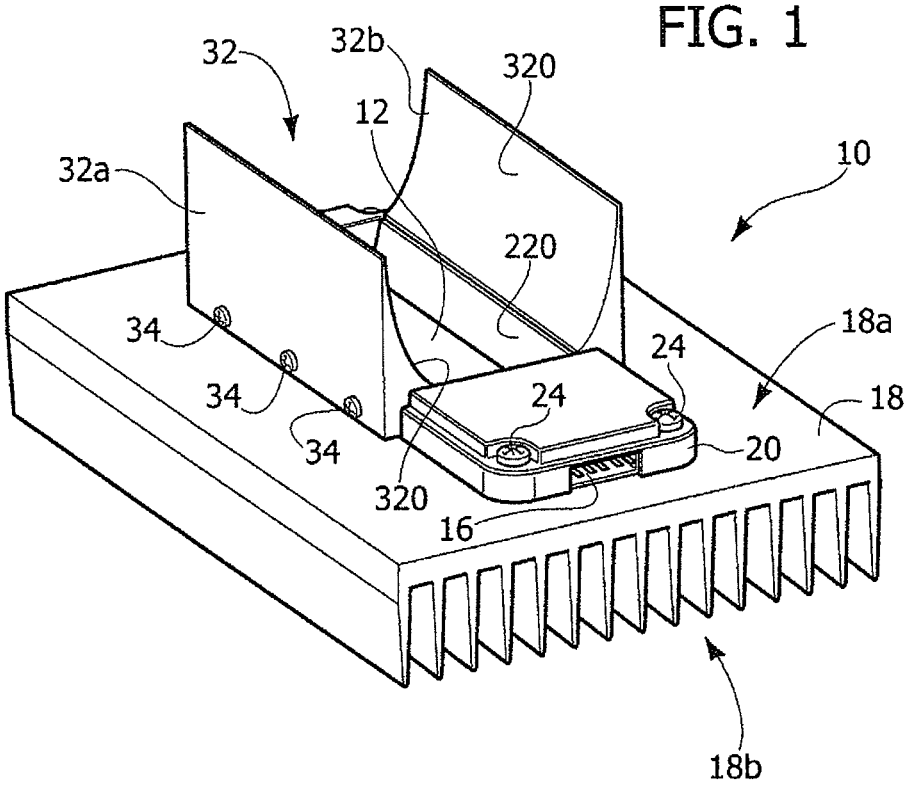
FIG. 1 is a view of one embodiment in the assembled state.
Figure 3:
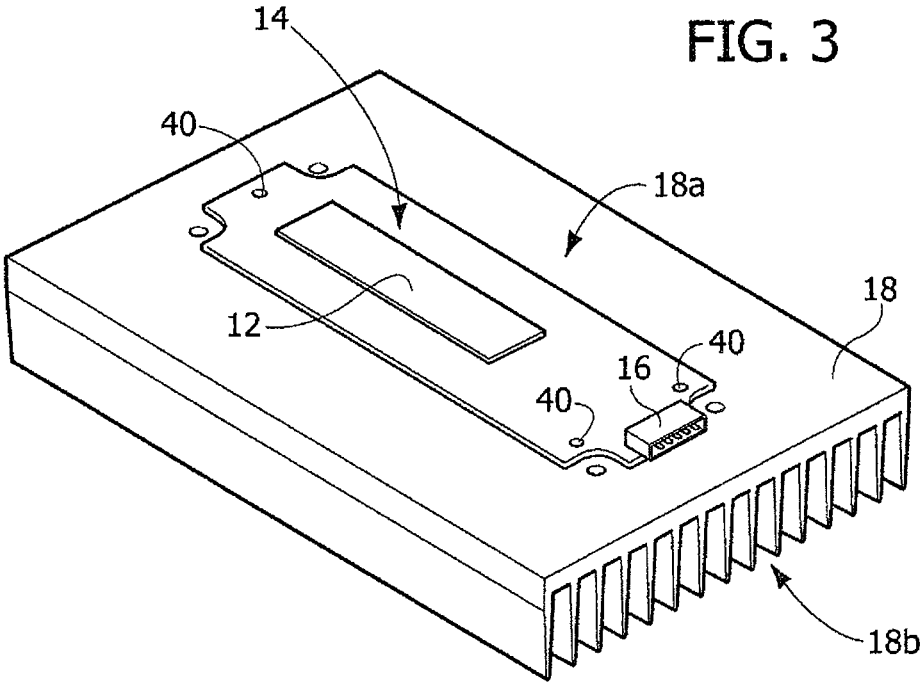

In the following description are illustrated various specific details intended for a deeper understanding of the embodiments. The embodiments may be constructed without one or more of the specific details, or with other methods, components, materials, etc. In other cases, well-known structures, materials or operations are not shown or described in detail in order to avoid obscuring the various aspects of the embodiments.

The reference to "an embodiment" in the scope of this description is to indicate that a particular configuration, structure or feature described in relation to the embodiment is comprised in at least one embodiment. Thus, phrases such as "in one embodiment", that may be present in various places throughout this description, do not necessarily refer to the same embodiment. Furthermore, particular layouts, structures or features may be combined in any suitable manner in one or more embodiments.

The references used here are only for convenience and do not therefore define the range of protection or the scope of the embodiments.

In the figures of the appended drawings, the reference 10 indicates overall a lighting assembly of the type commonly called "light engine" or "light engine system".

The various embodiments may involve, for example, a lighting assembly that uses an LED light source as source for generation of the light radiation. In various embodiments, the source 12 can take the form of an array of several LEDs arranged according to a solution of the type commonly referred to as "cluster" or "Chip-on-Board". In the embodiments considered here by way of non-limiting examples, the source 12 (to be considered per se as being of a well-known type) is shown in the form of a chip of rectangular shape. The reference to this particular embodiment should not be interpreted in any way in a limiting sense for the scope of the description.

In various embodiments, the source 12 is carried on a board (for example a Printed Circuit Board or PCB) 14 that can be provided with one or more connectors 16 for the electrical power supply to the source 12, for the potential transmission of corresponding control signals and/or for the transfer outside of the assembly 10 of detection or sensing signals. In various embodiments, this can be carried out according to well-known criteria or procedures that do not therefore need to be described in a very detailed way in this description.

The numerical reference 18 indicates overall a base body configured as a heat sink.

In various embodiments, the heat sink 18 can be composed of a slab structure (for example, flat) with a front surface 18*a* and a back surface 18*b*. The front surface 18*a* allows the mounting of the board 14 that carries the source 12, for example with the board 14 in thermal contact (for example by the effect of a light mechanical pressure) with the heat sink 18. The back surface 18*b* can be finned in order to facilitate the thermal dissipation.

The numerical reference 20 indicates overall an element corresponding to a block with a window, or a component of planar form having an opening 22 essentially corresponding to a window.

Figure 2:
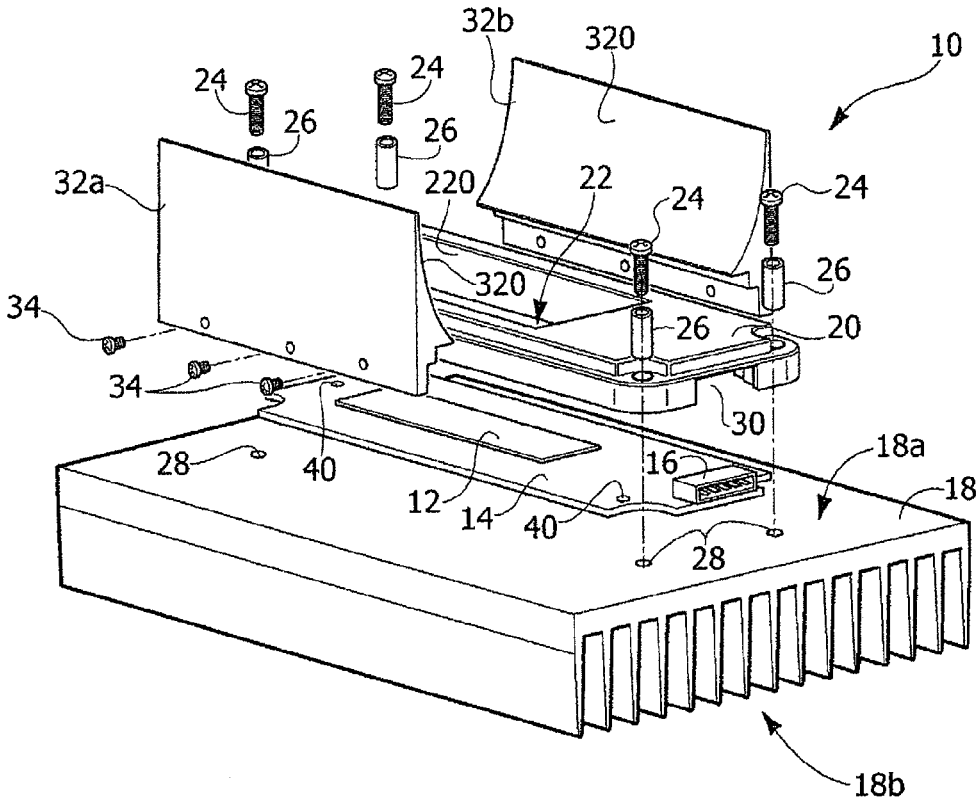
FIG. 2 is a view of one embodiment in the exploded state.
Figure 4:
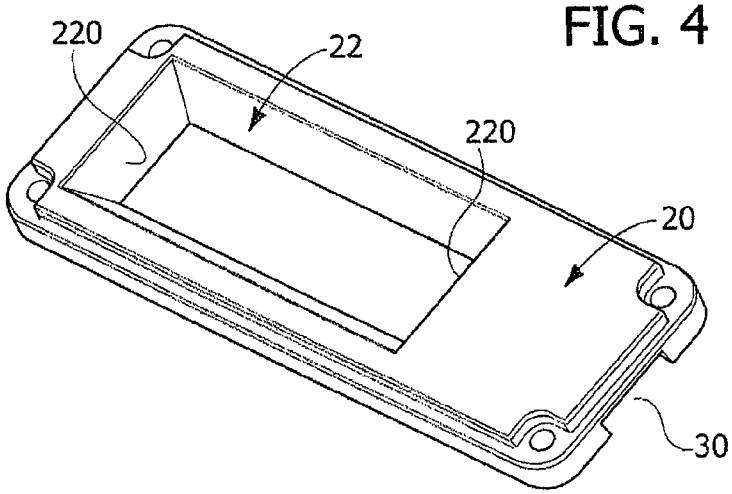

The structure of the element 20 will be better appreciated from the observation of FIGS. 4 and 6, whereas FIGS. 1 and 2 (in particular the latter) will allow it to be appreciated how the element 20 is intended to be applied to the top surface of the block 14 in such a manner that the window 22 ends up placed in a position corresponding to the source 12, so as to leave it at least partially (and preferably almost completely) uncovered. In the embodiments considered here by way of non-limiting example, the source 12 takes the form of a rectangular (or square) chip and the window 22 also itself has a similar or substantially similar shape. In various embodiments, different shapes may be chosen for the source 12, which could correspond to equally varied shapes for the window 22 and for the element 20 as a whole.

In various embodiments, the element 20 can be applied to the top surface of the block 14 carrying the source 12 attaching it to the heat sink 18 in relation to the front face 18*a*. In various embodiments, this may be achieved, for example, by means of screws 24 that pass through bushes 26 and that are designed to engage in openings 28 provided in the heat sink 18. In various embodiments, the element 20 may comprise a notch or recess 30 designed to accept the connector 16 for the block 14.

As will once again be better appreciated through the observation of FIGS. 1 and 2, in various embodiments, the side walls 220 of the window 22, that surround the source 12, present a diverging profile, by which the window 22 exhibits an increasing cross-sectional area starting from the side of the element 20 turned toward the block 14 (and hence the light source 12) and the opposite side of the element 20.

In various embodiments, this diverging profile of the side wall 220 (that may involve all of such side wall or else only a part of the latter) makes it so that the element 20 can play, aside from a general role of protection of the surface of the source 12 from the external environment, also the role of a "preliminary" optical reflector designed to make it so that the light radiation coming from the source 12 will be subjected to an at least partial pre-mixing, for example as far as the components of such radiation having different wavelengths (hence chromatic characteristics) are concerned, for example in order to generate a resulting white or substantially white light.

In various embodiments, the action of scattering the light radiation can be achieved by a diffuser or reflector 32 in which the walls 320 may be extended, for example with a parabolic profile, in a divergent direction starting from the window side walls 22.

In the exemplary embodiment considered here, the reflector element 32 comprises two elements or separate parts 32*a* and 32*b*. In various embodiments, the element 32 may however be composed of a single piece or else may comprise a number of pieces greater than two.

In the exemplary embodiment considered here, the two elements 32*a* and 32*b* of the reflector element run along two sides (in particular the two longest sides, in the exemplary embodiment considered here) of the window 22, hence of the source 12, for example starting from the longest sides of the latter.

The reflector element or elements in question are fixed to the element 20 for example by means of screws 34.

The combined observation of FIGS. 7 and 8 reveals that, in various embodiments, the element 20 and the reflector element 32 (whether it be in a single piece or in several parts) preferably have contact surfaces that are mutually cooperating, i.e. corresponding surfaces in which the reflector element 32 rests on the perimeter of the element 20, having complementary profiles such as for example the stepped complementary pattern indicated as 36.

Finally, FIG. 5 illustrates the possible presence, on the side of the element 20 intended to be turned toward the block 14, of pins 38 designed to engage in corresponding openings 40 provided in the block with the function of alignment and mutual fastening.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A lighting assembly comprising:

a base body configured as a heat sink having a front surface;

a board carrying a light radiation source positioned on the front surface of said base body;

a fixing element mounted on said front surface of said heat sink with said board arranged therebetween, wherein the fixing element includes a four-sided window that leaves at least partly uncovered said light radiation source, said window having four side walls that surround said light radiation source, spread outwards, and are configured to form a reflector for, and pre-mix a light radiation from, the light radiation source; and a pair of external reflectors mounted to the fixing element, an internal wall of each external reflector shaped and positioned so as to continue a surface of one side wall of said window of said fixing element, wherein the side walls of said window, at which the external reflectors are mounted, are on opposing sides of the window, and wherein the pair of external reflectors are separate pieces that are mounted only on two opposing sides to the fixing element.

2. The assembly of claim 1, wherein said fixing element is fixed to said front surface by screws.

3. The assembly of claim 1, wherein said fixing element and said board are provided with complementary pins and openings for mutual positioning.

4. The assembly of claim 1, wherein said board carries an electrical connector for said light radiation source and said fixing element includes a notch that embraces and abuts at least a top surface of the electrical connector.

5. The assembly of claim 1, wherein said external reflector includes reflective walls spreading outwards from the side walls of the window of said fixing element.

6. The assembly of claim 1, wherein said external reflector includes a plurality of parts.

7. The assembly of claim 1, wherein said external reflector is coupled to said fixing element by being mounted thereon.

8. The assembly of claim 5, wherein said fixing element and said external reflector are provided with complementary mating surfaces.

9. The assembly of claim 1, wherein said fixing element is fixed to said front surface by screws with the interposition of bushes.

10. The assembly of claim 1, wherein said external reflector is coupled to said fixing element by being mounted thereon via screws.

11. The assembly of claim 8, wherein said complementary mating surfaces have a stepped profile.

* * * * *